United States Patent [19]

Lasecki et al.

[11] 4,339,692

[45] Jul. 13, 1982

[54] POWER SUPPLY FOR HID LAMP

[75] Inventors: Robert R. Lasecki, Eastlake; Howard C. Reeve, III, Parma; Nicholas O. Lindan, Cleveland, all of Ohio

[73] Assignee: The Nuarc Company, Inc., Chicago, Ill.

[21] Appl. No.: 207,953

[22] Filed: Nov. 18, 1980

[51] Int. Cl.[3] ..... H05B 41/231

[52] U.S. Cl. ..... 315/277; 315/206; 315/219; 315/289; 315/DIG. 5

[58] Field of Search ..... 315/206, 208, 219, 225, 315/276–278, 289, 290, DIG. 2, DIG. 5, DIG. 7

[56] References Cited

U.S. PATENT DOCUMENTS 3,555,352 1/1971 Michalski ..... 315/289 X 4,167,689 9/1979 Quirke ..... 315/278 X

FOREIGN PATENT DOCUMENTS 748925 7/1980 U.S.S.R. ..... 315/290

*Primary Examiner*—Eugene R. La Roche

*Attorney, Agent, or Firm*—Mason, Kolehmainen, Rathburn & Wyss

[57] ABSTRACT

A power supply for a high intensity discharge lamp is provided wherein the secondary windings of a pair of lamp strike pulse transformers are connected in series with the HID lamp directly across the AC supply, the impedance of these secondary windings acting as the only ballast elements of the power supply. The HID lamp is chosen to have relatively high operating and maximum starting currents so that warm-up time of the lamp is dramatically reduced while employing the lamp strike pulse transformers to perform the dual function of starting the lamp when either hot or cold and acting as the current limiting ballast for the lamp both during warm-up and under normal operating conditions.

11 Claims, 4 Drawing Figures

42
46
44
30
22
12
26
18
16
34
10
50
48
52
LAMP STRIKE PULSE CIRCUIT
14
20
AC LINE
28
24
32
36
ZERO CROSSING DETECTOR
DELAY
DRIVE CIRCUIT
38
40
2 SEC. TIMER
39

84
86
12
14
82
AC LINE
80

~5" DIA.
1-1/4" SQUARE CORE
60
66
18
62
74
64
76

72
70
22
68
60
PRIMARY
PRIMARY
PRIMARY
66
62
SECONDARY
64
~3/4"
PRIMARY
74
76
4"

POWER SUPPLY FOR HID LAMP

BACKGROUND OF THE INVENTION

The present invention relates to power supplies, and more particularly to power supplies which are suitable for use with high intensity discharge (HID) lamps, particularly of the metal halide type.

FIELD OF THE INVENTION

One of the problems encountered with power supplies intended for use with HID lamps is that a discharge must be initiated in the lamp both when it is cold and has an extremely low voltage drop and also when the lamp is hot and has been turned off momentarily, the hot gases in the lamp under these conditions being under high pressure so that the lamp has a very high breakdown voltage. When the lamp is hot, so-called restrike pulses of extremely large amplitude must be developed, usually by means of a pair of pulse transformers connected in series on each side of the lamp in order to break down the high internal resistance of the lamp and initiate a discharge therein. Arrangements employing such pulse transformers are shown in Lindan copending application Ser. No. 166,159 filed July 7, 1980, and the prior art arrangements described in the introductory portion of that application.

When the lamp is cold, it is relatively easy to strike an arc in the lamp but since the lamp has a very low voltage drop when it is cold, some means must be provided for limiting the maximum current drawn by the lamp when a discharge is first initiated therein. Conventionally the current is limited by a ballast impedance, usually in the form of an inductance or capacitance, which is connected in series with the power transformer to limit the current flowing to the lamp to a relatively low value. If the current is limited to the normal operating current of the lamp, the so-called warm-up time which is required for the lamp to reach full light output may be as long as from ninety seconds to several minutes.

Various arrangements have been proposed for decreasing the warm-up time required for the lamp to reach full light output after a discharge is initiated in a cold lamp. For example, Michalski U.S. Pat. No. 3,555,352 provides an arrangement involving a saturable auto transformer and series capacitor which operate at or near resonance during the warm-up period to increase the current to the lamp and reduce the warm-up period to approximately forty-five seconds.

Helmuth U.S. Pat. No. 3,944,876 proposes to reduce the warm-up period by employing a separate auto transformer which is selectively connected into the circuit by means of a triac controlled by a pulse generator arrangement, this circuit functioning to decrease the voltage and effective ballast impedance available to the lamp during the warm-up period.

Both of these prior art arrangements require separate expensive circuit components to accomplish the two functions of starting the lamp when either hot or cold and increasing the current initially flowing to the lamp when cold so as to decrease the warm-up time required to reach full light output.

It is, therefore, an object of the present invention to provide a new and improved HID power supply wherein one or more of the above-discussed disadvantages of the prior art arrangements is avoided.

It is another object of the present invention to provide a new and improved HID lamp power supply which provides a simplified circuit arrangement for both minimizing the warm-up time of the lamp and providing restrike pulses of relatively high amplitude for restarting the lamp when it is hot and has been turned off momentarily.

It is a further object of the present invention to provide a new and improved HID lamp power supply wherein the conventional ballast elements are eliminated and the pulse transformers employed to develop the necessary strike pulses for initiating a discharge in the lamp are themselves used as the only current limiting elements in the power supply.

BRIEF SUMMARY OF THE INVENTION

Briefly considered, in the arrangement of the present invention the conventional series ballast elements are eliminated and the pulse transformers which are connected in series with each side of the lamp also act as the only current limiting elements in the power supply both during the initial warm-up period and when full operating current is flowing through the lamp and it is producing full light output.

Since the ballasting effect of the pulse transformers is relatively small, a lamp with higher than normal operating current must be used in the arrangement of the present invention. These pulse transformers then permit an extremely large value of current to flow through the lamp during the initial warm-up period so that the time required for the lamp to reach full light output is dramatically reduced from forty-five seconds to from fifteen to twenty seconds.

BRIEF DESCRIPTION OF THE DRAWINGS

The invention both as to its organization and method of operation, together with further objects and advantages thereof, will best be understood by reference to the following specification taken in connection with the accompanying drawings, in which.

DESCRIPTION OF THE PREFERRED EMBODIMENT

Figure 1:
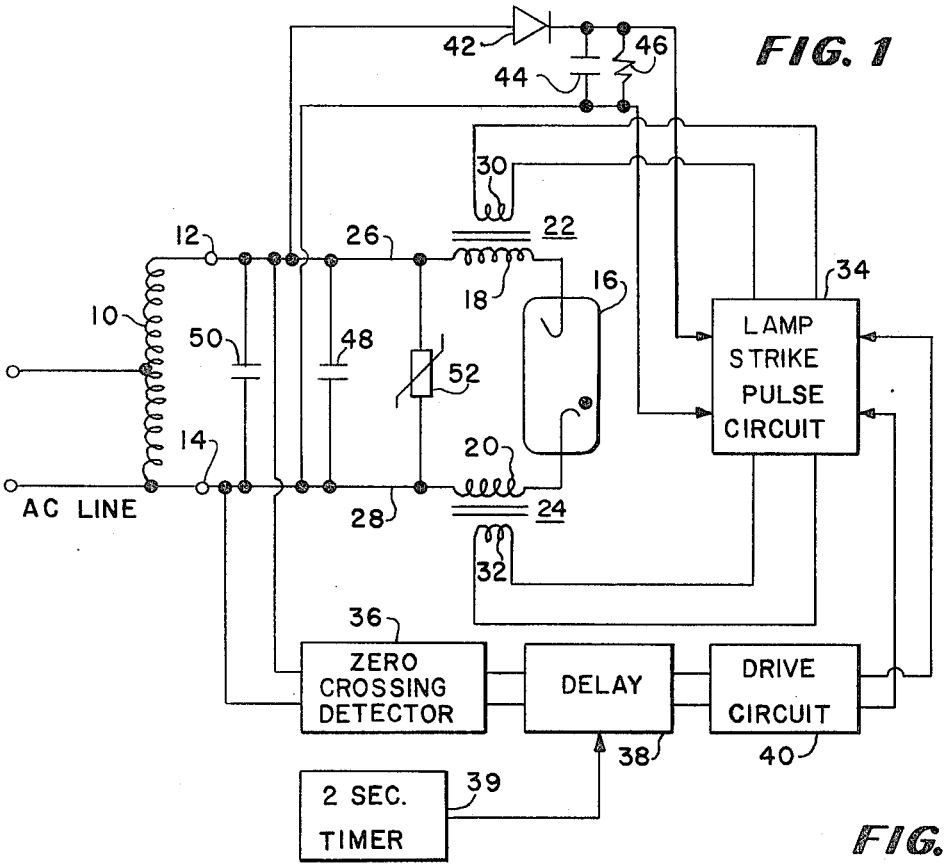
FIG. 1 is a schematic diagram of the power supply arrangement of the present invention.

Referring now to the drawings, an auto transformer 10 is employed to transform the voltage from the a.c. line to the required voltage across the output terminals 12, 14 of the transformer 10.

A metal halide lamp indicated generally at 16 is connected directly across the transformer terminals 12, 14 through the secondary windings 18 and 20, respectively, of a pair of pulse transformers 22, 24.

In accordance with an important aspect of the present invention, the secondary windings 18, 20 are directly connected to the auto transformer 10 by means of the conductors 26, 28 and the secondary windings 18, 20 themselves act as the only current limiting ballast elements for the power supply. The pulse transformers 22, 24 are provided with the primary windings 30, 32 to which lamp strike pulses of relaively high current value are applied from a lamp strike pulse circuit 34.

In order to provide drive pulses for the lamp strike circuit 34, so that this circuit may be operated in synchronism with the a.c. supply, a zero crossing detector 36 is connected across the output terminals 12, 14 of the auto transformer 10, the detector 36 providing an output pulse for each zero crossover point of the a.c. voltage from the auto transformer 10. These pulses are delayed in a delay circuit 38 by approximately seventy-five degrees so that the lamp strike pulses developed by the circuit 34 will occur at a point on the a.c. wave at which the a.c. voltage applied to the lamp 16 is near its maximum value. The delayed zero crossover pulses are supplied to a drive circuit 40 which provides suitable output pulses for driving the lamp strike pulse circuit 34. A two-second timer 39, which is controlled by application of power to the power supply, is employed to control the delay circuit 38 so that the lamp strike pulse circuit 34 is operative to develop lamp strike pulses of current in the primary windings 30, 32 only for a brief period of two seconds after the power is turned on after which the delay circuit 38 is disabled and no further lamp strike pulses are developed, also as described in detail in said copending Lindan application, it being assumed that two seconds is ample time within which to initiate a discharge in the lamp 16 irrespective of whether the lamp is hot or cold.

Preferably, the lamp strike pulse circuit 34 is of the type shown and described in detail in Lindan application Ser. No. 166,159, referred to previously. In a lamp strike pulse circuit of this type, the a.c. voltage developed across the transformer 10 is rectified by means of the rectifier 42 and filtered in the circuit comprising the filter capacitor 44, the d.c. voltage developed across the capacitor 44 then being employed to charge a pair of lamp strike capacitors within the circuit 34, as described in detail in said copending Lindan application.

A bypass capacitor 48 is connected across the ends of the secondary windings 18, 20 so as to prevent the lamp strike pulses which are developed across these windings from affecting the auto transformer 10. Also, a power factor correction capacitor 50 of relatively large value is connected across the auto transformer 10.

In addition, a metal oxide protective device 52 is connected across the capacitors 48 and 50 as a safety feature to prevent high voltage pulses from appearing across terminals 12 and 14, such device clamping the maximum voltage at these points at 420 V.

Figure 4:
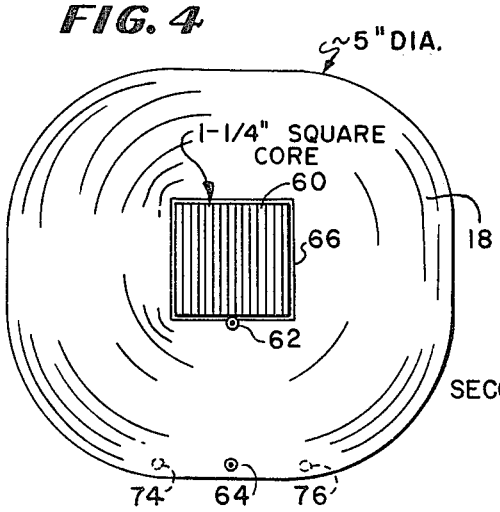
FIG. 4 is a left-end view of the transformer of FIG. 3.
Figure 3:
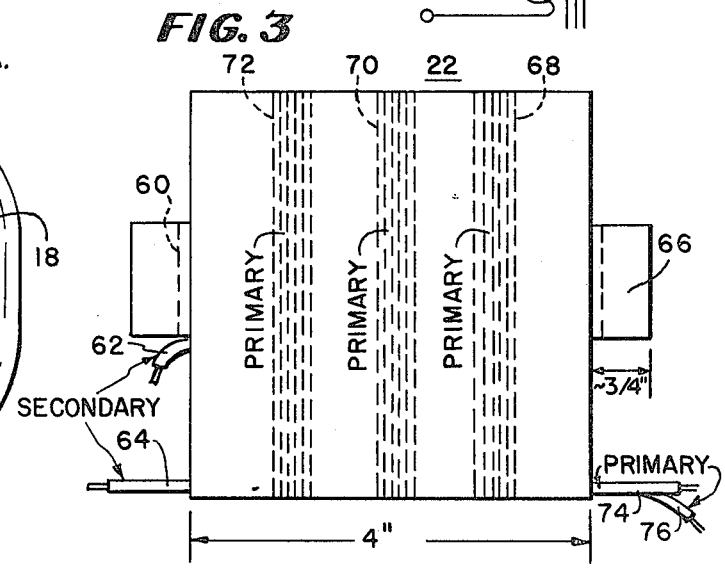
FIG. 3 is a side elevational view of the pulse transformer used in the embodiment of FIG. 1.

In FIGS. 3 and 4, a pulse transformer construction is shown which has been found suitable to fulfill the dual functions of the present invention, i.e. that of developing high amplitude lamp strike pulses and also acting as a ballast element to limit the maximum current flowing through the lamp when a discharge is initiated in a cold lamp.

Referring to these figures, the secondary winding, such as the winding 18 of the pulse transformer 22, is wound on a square core 60, the winding 18 comprising approximately three hundred turns of No. 10 AWG wire of square cross section provided with suitable insulation between turns, the starting lead 62 of the winding 18 extending from one side of the transformer 22 adjacent the core and the end lead 64 thereof extending from the same side of the transformer at the periphery of the winding 18. A square core sheathing 66 of suitable insulating material is positioned around the core 60 before the winding 18 is wound thereon.

The primary winding 30 consists of approximately three turns of No. 20 AWG wrapped wire, each turn actually comprising five separate conductors which are quinta-filar wound around the secondary winding, these turns being spaced apart to form the three bands of conductors 68, 70 and 72 which are distributed along the length of the secondary winding 18, the starting and ending leads 74 and 76 extending from the transformer 22 on the side opposite the secondary leads 62, 64. The pulse transformer of FIGS. 3 and 4 should also have suitable insulation so that it will withstand 500 volts across the primary winding 30, 35,000 volts across the secondary winding 18, and 35,000 volts between the primary to secondary windings.

In accordance with a further important aspect of of the present invention, the lamp 16 is designed so that it has a much higher normal operating current than conventional lamps of the same light output. For example, in the 2 KW range a conventional lamp will have a normal operating current of ten amps with a voltage of 200 volts across the lamp, whereas a 2 KW lamp 16 in accordance with the present invention will have a normal operating current of twenty amperes, i.e. twice that of the conventional lamp and will have a 100 volt drop across the lamp.

With the construction shown and described in connection with FIGS. 3 and 4, the secondary windings 18 and 20 of the pulse transformers 22 and 24 will have an inductance of 9 millihenries each so that these two secondary windings collectively represent a series impedance of approximately seven ohms in series with the lamp 16, when a 60 Hz power source is used. Accordingly, with a normal operating current of twenty amperes flowing through the lamp 16 a voltage drop of approximately 110 volts is developed across the two secondary windings 18, 20 so that the output voltage developed at the terminals 12, 14 by the auto transformer 10 may be as high as 210 volts and still provide the required 100 volt drop across the lamp 16. A supply voltage of 210 volts a.c. is sufficient to prevent the lamp 16 from going out even though this lamp is operated directly from the a.c. voltage developed across the terminals 12, 14. In such a 2 KW power supply, the capacitor 48 may have a value of 2.0 microfarads, the capacitor 50 a value of 180.0 microfarads and the device 52 a protective breakdown voltage of 420 volts. Furthermore, with the pulse transformer construction shown in FIGS. 3 and 4, lamp strike pulses of approximately 17,500 volts are developed across each of the windings 18 and 20 so as to provide total amplitude lamp strike pulses of approximately 35,000 volts which are sufficient to restart the 2 KW lamp 16 is almost instantaneously even when this lamp is hot and is turned off momentarily.

In accordance with a further aspect of the present invention, the same pulse transformer construction and other power supply components may also be employed to provide a suitable power supply when the lamp 16 is chosen to develop 5 KW output, it being necessary in such instance only to provide a different auto transformer 10 which develops approximately 310 volts at the output terminals 12, 14. With such a 5 KW power supply, the lamp 16 is chosen so that it has a normal operating current of twenty-five amperes and operates with a 200 volts voltage drop across the lamp. Thus, under normal operating conditions for a 5 KW lamp, a voltage drop of approximately 110 volts will be developed across the secondary windings 18, 20 and with a 200 volt drop across the 5 KW lamp 16.

In accordance with a further aspect of the present invention the maximum starting current of the lamp 16 is limited by the impedance presented by the secondary windings 18, 20 so that the maximum current carrying capabilities of the lamp 16 are not exceeded. However, since the secondary windings 18, 20 have relatively small impedance, the maximum starting current is much larger than in conventional tubes so that the plasma energy density, which is proportional to the square of the current, is increased greatly as compared to conventional lamp operation. As a result, the warm-up time required to reach full light output for the lamp 16 in the present invention is greatly reduced over prior arrangements. More particularly, in the 2 KW power supply situation, wherein a 210 volt supply is provided at the terminals 12, 14 a voltage drop of approximately twenty volts is developed across the lamp 16 when an arc is initially struck in this lamp while cold and the secondary windings 18, 20 which have a combined impedance of approximately 7.0 ohms, function to limit the maximum starting current to approximately 30 amperes.

When a 5 KW lamp is employed and a voltage supply of 310 volts is provided at the terminals 12, 14 a voltage drop of approximately 40 volts will be produced across this lamp when an arc is initially struck in a cold lamp and the secondary windings 18, 20 will function to limit the maximum starting current to approximately 40 amperes. Thus, with the arrangement of the present invention, a warm-up time of from ten to twelve seconds is provided for a 5 KW lamp and a warm-up from twelve to fifteen seconds is provided for a 2 KW lamp, these warm-up periods being substantially less than those achieved by conventional lamp power supply arrangements. Furthermore, in both the 2 KW and 5 KW power supply arrangements of the present invention the maximum starting current is less than twice the normal operating current of the lamp, whereas in conventional lamp power supplies the maximum starting current is approximately three times as large as the normal operating current of the lamp and yet warm-up periods of 45 seconds or more are usually required.

The lamp power supply arrangement shown in FIG. 1 does not provide regulation against variations of the a.c. voltage supplied to the auto transformer 10. However, when the lamp 16 is employed in graphic art applications wherein the light output of the lamp 16 must be accurately controlled to desired exposure intervals, a light integrator-timer arrangement, such as disclosed in Waiwood application Ser. No. 138,923 filed Apr. 10, 1980 and assigned to the same assignee as the present application, may be employed to provide the necessary compensation for line voltage variations which will affect the light output of the lamp 16.

Figure 2:
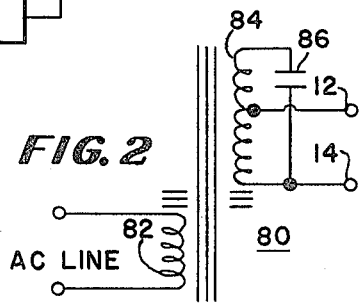
FIG. 2 illustrates an alternative embodiment of this invention.

In the alternative, a voltage regulating arrangement may be employed wherein a ferroresonant transformer is substituted for the auto transformer 10 to provide line regulation. More particularly, a shown in FIG. 2, the a.c. line may be supplied to a ferroresonant transformer indicated generally at 80 and having a primary winding 82 connected to the a.c. line. The secondary winding 84 of the ferroresonant transformer 80 is resonated with the capacitor 86 so as to provide a regulated a.c. voltage at the terminals 12, 14 of the desired magnitude, it being understood that the circuit arrangement shown in FIG. 2 is substituted for the auto transformer 10 of FIG. 1, in this voltage regulating embodiment of the present invention.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A circuit for supplying power to a high intensity discharge lamp from an alternating current source, comprising a power supply transformer energized from an AC source and having an output winding, a cold cathode high intensity discharge lamp, a pair of lamp strike pulse transformers each having a primary and secondary winding, means connecting said HID lamp and said secondary windings of said pulse transformers in series directly across said transformer output winding, means for supplying lamp strike current pulses to said primary windings, the turns ratio between said primary and secondary windings of said pulse transformers being such that lamp strike pulses are produced across said secondary windings which are of sufficient magnitude to initiate a discharge in said lamp when said lamp is hot, said secondary windings remaining unsaturated when a discharge is initiated in said lamp when it is cold so that said secondary windings limit the current flowing through said lamp to a maximum permissible value during warm up of the lamp.

2. The power supply of claim 1, wherein said lamp has a normal operating current which is approximately half as large as said maximum permissible warm-up value.

3. The power supply of claim 1, wherein said lamp when hot has an operating current of about twenty-five amperes and an operating voltage of approximately 200 volts.

4. The power supply of claim 1, wherein said lamp when hot has an operating current of about twenty amperes and an operating voltage of approximately 100 volts.

5. The power supply of claim 1, wherein said secondary windings collectively have an inductance of about 18 millihenries.

6. The power supply of claim 1, wherein said pulse transformers each have a turns ratio between secondary and primary windings thereof of about 100 to 1.

7. The power supply of claim 1, wherein said pulse transformers each develop lamp strike pulses across the secondary winding thereof of about 25,000 volts magnitude so that said lamp may be restarted when hot almost instantaneously.

8. The power supply of claim 1, wherein said power supply transformer is an autotransformer and said output winding does not saturate when a current of said maximum permissible value is drawn by said lamp.

9. The power supply of claim 1, wherein said power supply transformer is a ferroresonant transformer for providing a substantially constant voltage across said output winding despite variations in said AC source.

10. The power supply of claim 1, wherein said lamp is a metal halide HID lamp having relatively low pressure so that the amount of metal within the lamp which must be vaporized during warm-up is small.

11. The power supply of claim 1, wherein said pulse transformers each develop lamp strike pulses across the secondary winding thereof of about 17,500 volts magnitude so that said lamp may be restarted when hot almost instantaneously.

* * * * *